US010234794B2

(12) United States Patent
Imai et al.

(10) Patent No.: US 10,234,794 B2
(45) Date of Patent: Mar. 19, 2019

(54) ROLLER MEMBER AND IMAGE FORMING APPARATUS INCLUDING THE ROLLER MEMBER

(71) Applicants: Masakazu Imai, Kanagawa (JP); Tsutomu Kato, Kanagawa (JP); Katsuhito Haruno, Kanagawa (JP); Osamu Ichihashi, Kanagawa (JP); Takahiro Konishi, Tokyo (JP)

(72) Inventors: Masakazu Imai, Kanagawa (JP); Tsutomu Kato, Kanagawa (JP); Katsuhito Haruno, Kanagawa (JP); Osamu Ichihashi, Kanagawa (JP); Takahiro Konishi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/370,301

(22) Filed: Dec. 6, 2016

(65) Prior Publication Data

US 2017/0168429 A1 Jun. 15, 2017

(30) Foreign Application Priority Data

Dec. 15, 2015 (JP) ..... 2015-244409

(51) Int. Cl.
*G03G 15/16* (2006.01)

(52) U.S. Cl.
CPC ..... *G03G 15/162* (2013.01); *G03G 15/1685* (2013.01)

(58) Field of Classification Search
CPC ..... G03G 15/162; G03G 15/1615
See application file for complete search history.

(56) References Cited

U.S. PATENT DOCUMENTS

| | | | | |
|---|---|---|---|---|
| 2,987,994 | A * | 6/1961 | Allison | B41F 27/105 101/375 |
| 2006/0210324 | A1 | 9/2006 | Kuma et al. | |
| 2006/0280518 | A1* | 12/2006 | Kamoshida | G03G 15/0233 399/100 |
| 2007/0127947 | A1 | 6/2007 | Kuma et al. | |
| 2007/0286640 | A1 | 12/2007 | Katoh et al. | |
| 2010/0046998 | A1* | 2/2010 | Imaizumi | G03G 15/0233 399/353 |
| 2010/0067952 | A1 | 3/2010 | Fujita et al. | |
| 2010/0142985 | A1 | 6/2010 | Minbe et al. | |
| 2010/0221029 | A1 | 9/2010 | Minbu et al. | |
| 2011/0158690 | A1 | 6/2011 | Mimbu et al. | |
| 2013/0223901 | A1 | 8/2013 | Minbe et al. | |
| 2014/0334847 | A1 | 11/2014 | Takahashi et al. | |

FOREIGN PATENT DOCUMENTS

| | | |
|---|---|---|
| JP | 6-051656 | 2/1994 |
| JP | 2015-059967 | 3/2015 |

* cited by examiner

*Primary Examiner* — David M. Gray
*Assistant Examiner* — Andrew V Do
(74) *Attorney, Agent, or Firm* — Oblon, McClelland, Maier & Neustadt, L.L.P.

(57) ABSTRACT

A roller member includes a cored bar, an elastic layer, and a non-conductive member. The elastic layer is disposed on an outer circumferential face of the cored bar. The cored bar has a projecting portion projecting beyond a range in which the elastic layer is disposed, toward an axial end of the cored bar. The non-conductive member is made of a non-conductive material. The non-conductive member is disposed on the projecting portion. The non-conductive member bites into an end face of an axial end of the elastic layer.

17 Claims, 6 Drawing Sheets

ROLLER MEMBER AND IMAGE FORMING APPARATUS INCLUDING THE ROLLER MEMBER

CROSS-REFERENCE TO RELATED APPLICATION

This patent application is based on and claims priority pursuant to 35 U.S.C. § 119(a) to Japanese Patent Application No. 2015-244409, filed on Dec. 15, 2015, in the Japan Patent Office, the entire disclosure of which is hereby incorporated by reference herein.

BACKGROUND

Technical Field

Aspects of the present disclosure relate to a roller member having a cored bar and an elastic layer on an outer circumferential face of the cored bar, and an electrophotographic image forming apparatus, such as a copier, a printer, a facsimile machine, or a multifunction peripheral having at least two of the foregoing capabilities that includes the roller member, and particularly to a roller member, such as a secondary transfer roller or a secondary transfer opposite roller, to which high voltage is to be applied, and an image forming apparatus that includes the roller member.

Related Art

There has been conventionally known an image forming apparatus, such as a copier or a printer that uses a roller member in which an elastic layer is formed on the outer circumferential face of a cored bar, as a roller member such as a secondary transfer roller and a secondary transfer opposite roller, and performs a secondary transfer step by applying a secondary transfer bias being high voltage, to the roller member. Specifically, in a color image forming apparatus, an intermediate transfer belt travels in a predetermined direction, and respective toner images are primarily transferred onto the intermediate transfer belt and superimposed one on another at the positions of a plurality of primary transfer nips. Then, the toner image is secondarily transferred onto a recording medium conveyed to the position of a secondary transfer nip of the intermediate transfer belt and a secondary transfer roller. This secondary transfer nip is formed by the secondary transfer roller and a secondary transfer opposite roller contacting each other via the intermediate transfer belt. In addition, such a secondary transfer step is performed by applying a predetermined secondary transfer bias to at least either one of the secondary transfer roller and the secondary transfer opposite roller.

In some cases, a support including a collar or a spacer is rotatably installed on a support shaft of the roller member to which the secondary transfer bias is to be applied, so as not to generate leakage by applying the secondary transfer bias being high voltage, to the roller member such as the secondary transfer roller and the secondary transfer opposite roller.

SUMMARY

In one aspect of the present disclosure, there is provided a roller member that includes a cored bar, an elastic layer, and a non-conductive member. The elastic layer is disposed on an outer circumferential face of the cored bar. The cored bar has a projecting portion projecting beyond a range in which the elastic layer is disposed, toward an axial end of the cored bar. The non-conductive member is made of a non-conductive material. The non-conductive member is disposed on the projecting portion. The non-conductive member bites into an end face of an axial end of the elastic layer.

In another aspect of the present disclosure, there is provided a roller member that includes a cored bar and an elastic layer. The elastic layer is disposed on an outer circumferential face of the cored bar. The cored bar has a projecting portion projecting beyond a range in which the elastic layer is disposed, toward an axial end of the cored bar. The elastic layer has a small diameter portion at an axial end of the elastic layer. The smaller diameter portion has an outer diameter smaller than an outer diameter of another portion of the elastic layer. The non-conductive member is made of a non-conductive material. The non-conductive member is fitted to the small diameter portion of the elastic layer, to cover the projecting portion.

In yet another aspect of the present disclosure, there is provided an image forming apparatus that includes an image bearer, a transfer roller, the roller member according to any of the above-described aspects, and a power source. The image bearer bears a toner image. The transfer roller forms a transfer nip between the transfer roller and the image bearer. The roller member is disposed opposing the transfer roller via the image bearer at the transfer nip. The power source outputs a transfer bias to transfer the toner image from the image bearer onto a recording medium at the transfer nip. The power source directly or indirectly applies the transfer bias to the cored bar.

In yet another aspect of the present disclosure, there is provided an image forming apparatus that includes an image bearer, the roller member according to any of the above-described aspects, and a power source. The image bearer bears a toner image. The roller member is disposed opposing the image bearer to form a transfer nip between the roller member and the image bearer. The power source outputs a transfer bias to transfer the toner image from the image bearer onto a recording medium at the transfer nip. The power source directly or indirectly applies the transfer bias to the cored bar.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
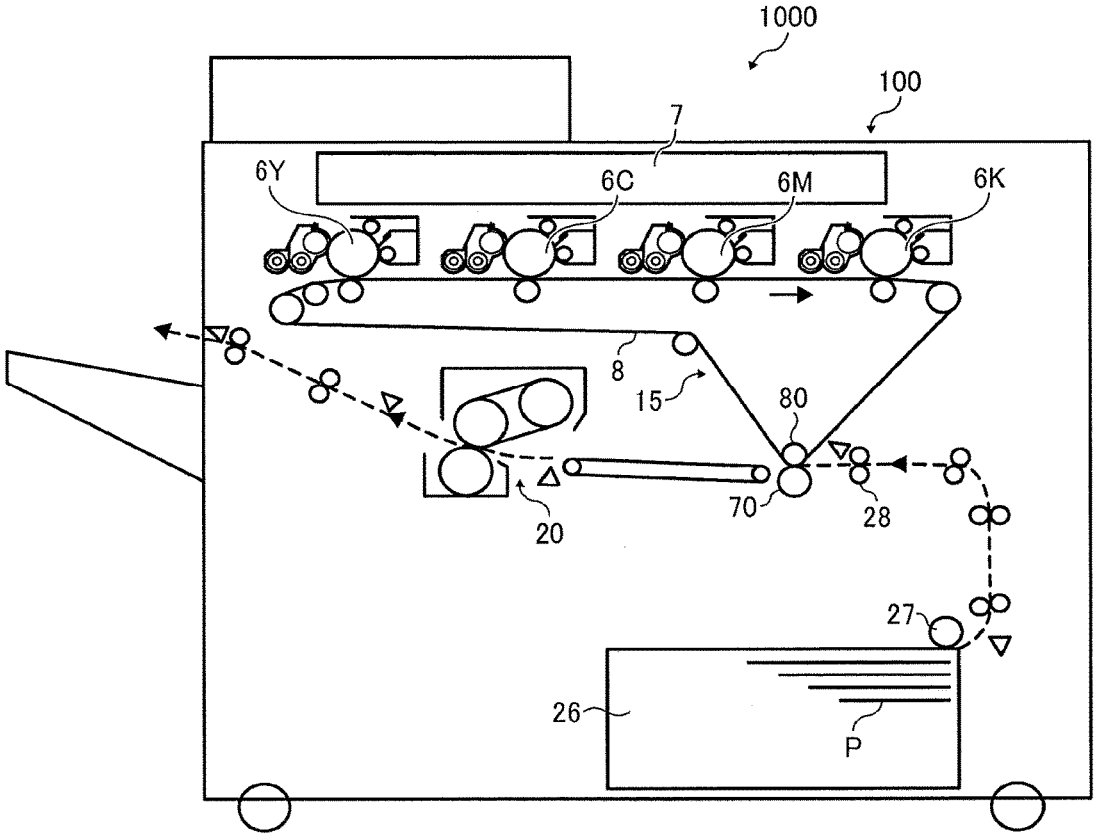
FIG. 1 is a general arrangement diagram illustrating an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Embodiments of the present disclosure will be described in detail below referring to the drawings. In addition, in the drawings, the same or corresponding parts are assigned the same signs, and the redundant descriptions thereof will be appropriately simplified or omitted.

First Embodiment

Figure 2:
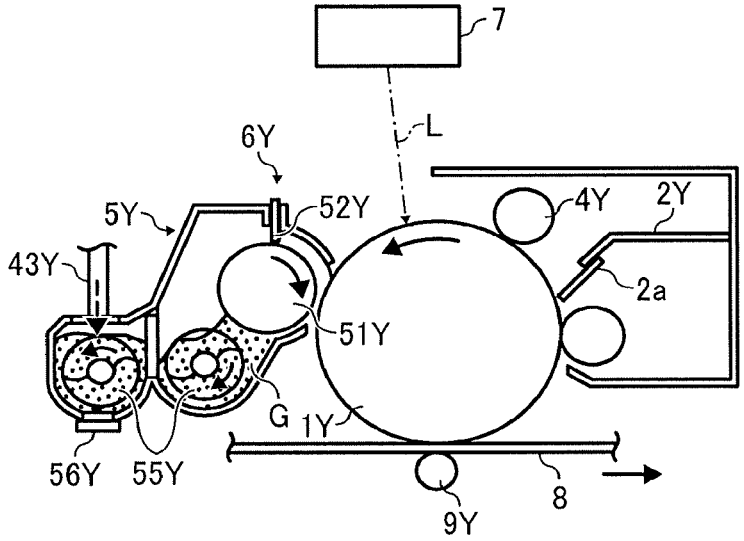
FIG. 2 is a configuration diagram illustrating a part of an image forming unit according to an embodiment of the present disclosure, in an enlarged manner.

A first embodiment of the present disclosure will be described in detail using FIGS. 1 to 7. First, referring to FIGS. 1 and 2, the general arrangement and the operation of an image forming apparatus 1000 will be described. FIG. 1 is a configuration diagram illustrating a printer serving as an image forming apparatus. FIG. 2 is an enlarged view illustrating an image forming unit of the image forming apparatus. As illustrated in FIG. 1, an intermediate transfer belt device 15 is installed at the center of an apparatus body 100. In addition, image forming units 6Y, 6M, 6C, and 6K corresponding to the respective colors (yellow, magenta, cyan, and black) are disposed side by side to oppose an intermediate transfer belt 8 (image bearer) of the intermediate transfer belt device 15.

Referring to FIG. 2, the image forming unit 6Y corresponding to yellow includes a photoconductor drum 1Y serving as a photoconductor, a charging unit 4Y disposed at the circumference of the photoconductor drum 1Y, a developing unit 5Y, a cleaning unit 2Y, electric discharging unit, and the like. In addition, an image forming process (a charging step, an exposure step, a developing step, a transfer step, and cleaning step) is performed on the photoconductor drum 1Y, so that a yellow image is formed on the photoconductor drum 1Y.

In addition, the other three image forming units 6M, 6C, and 6K also have substantially the same configurations as the configuration of the image forming unit 6Y corresponding to yellow, except that the colors of toners to be used are different. Images corresponding to the respective toner colors are formed on the image forming units 6M, 6C, and 6K. Hereinafter, the descriptions of the other three image forming units 6M, 6C, and 6K will be appropriately omitted, and only the description of the image forming unit 6Y corresponding to yellow will be given.

Referring to FIG. 2, the photoconductor drum 1Y is driven by a drive motor to rotate in a counterclockwise direction. Then, the surface of the photoconductor drum 1Y is uniformly charged at the position of the charging unit 4Y (corresponds to the charging step). After that, the surface of the photoconductor drum 1Y reaches an irradiation position of laser light L emitted from an exposure unit 7, and at the position, an electrostatic latent image corresponding to yellow is formed through an exposure scanning performed (corresponds to the exposure step).

Then, the surface of the photoconductor drum 1Y reaches a position opposing the developing unit 5Y, and the electrostatic latent image is developed at the position, so that a yellow toner image is formed (corresponds to the developing step). After that, the surface of the photoconductor drum 1Y reaches a position opposing the intermediate transfer belt 8 (belt member) serving as an image bearer, and a primary transfer roller 9Y, and at the position, the toner image on the photoconductor drum 1Y is transferred onto the intermediate transfer belt 8 (corresponds to the primary transfer step). At this time, a small amount of untransferred toner remains on the photoconductor drum 1Y.

After that, the surface of the photoconductor drum 1Y reaches a position opposing the cleaning unit 2Y, and at the position, the untransferred toner remaining on the photoconductor drum 1Y is collected by a cleaning blade 2*a* into the cleaning unit 2Y (corresponds to the cleaning step). Lastly, the surface of the photoconductor drum 1Y reaches a position opposing the electric discharging unit, and residual potential on the photoconductor drum 1Y is removed at the position. In this manner, a series of image forming processes performed on the photoconductor drum 1Y ends.

In addition, the above-described image forming processes are performed also in the other image forming units 6M, 6C, and 6K similarly to the yellow image forming unit 6Y. In other words, the laser light L that is based on image information is emitted from the exposure unit 7 disposed above the image forming units toward photoconductor drums 1M, 1C, and 1K of the respective image forming units 6M, 6C, and 6K. Specifically, the exposure unit 7 emits the laser light L from a light source onto the photoconductor drums via a plurality of optical elements while scanning the laser light L using a polygon mirror driven to rotate. After that, the toner images of the respective colors that have been formed on the respective photoconductor drums through the developing step are primarily transferred onto the intermediate transfer belt 8 and superimposed one on another. In this manner, a color image is formed on the intermediate transfer belt 8.

Figure 3:
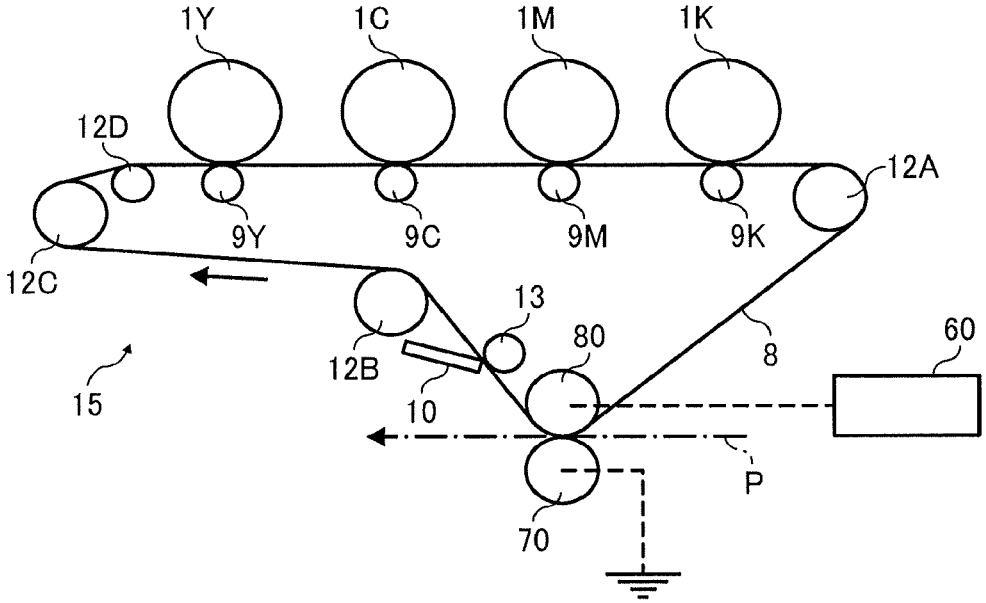
FIG. 3 is a schematic view illustrating a vicinity of an intermediate transfer belt according to an embodiment of the present disclosure.

Here, referring to FIG. 3, the intermediate transfer belt device 15 includes the intermediate transfer belt 8 serving as an image bearer, four primary transfer rollers 9Y, 9M, 9C, and 9K, a drive roller 12A, a secondary transfer opposite roller 80 (transfer opposite member) serving as a roller member, tension rollers 12B to 12D, a cleaning opposite roller 13, an inter mediate transfer cleaner 10, a secondary transfer roller 70 (transfer member), and the like. The intermediate transfer belt 8 is stretched around and supported by the plurality of roller members (i.e., the secondary transfer opposite roller 80, the drive roller 12A, the tension rollers 12B to 12D, and the cleaning opposite roller 13), and is endlessly moved by the rotational driving of one roller member (the drive roller 12A) in a direction indicated by arrow D1 in FIG. 3.

The four primary transfer rollers 9Y, 9M, 9C, and 9K and the photoconductor drums 1Y, 1M, 1C, and 1K, respectively, nip the intermediate transfer belt 8 to form primary transfer nips. Then, transfer voltage (primary transfer bias) having a reverse polarity of the polarity of toner is applied to the primary transfer rollers 9Y, 9M, 9C, and 9K. Then, the intermediate transfer belt 8 travels in the direction indicated by arrow D1, and sequentially passes through the primary transfer nips of the primary transfer rollers 9Y, 9M, 9C, and 9K. In this manner, the toner images of the respective colors on the photoconductor drums 1Y, 1M, 1C, and 1K are primarily transferred onto the intermediate transfer belt 8 and superimposed one on another.

After that, the intermediate transfer belt 8 on which the toner images of the respective colors are primarily transferred and superimposed one on another reaches a position opposing the secondary transfer roller 70. At the position, the secondary transfer opposite roller 80 (roller member) nips the intermediate transfer belt 8 between the secondary transfer opposite roller 80 and the secondary transfer roller 70 to form a transfer nip (secondary transfer nip). Then, the toner image of four colors that is formed on the intermediate transfer belt 8 is secondarily transferred onto a recording medium P such as a sheet of paper that has been conveyed to the position of the secondary transfer nip (transfer nip). At this time, untransferred toner that has not been transferred onto the recording medium P remains on the intermediate transfer belt 8.

Then, the intermediate transfer belt 8 reaches the position of the intermediate transfer cleaner 10. Then, the untransferred toner on the intermediate transfer belt 8 is removed at the position. In this manner, a series of transfer processes performed on the intermediate transfer belt 8 ends.

Here, referring to FIG. 1, the recording medium P conveyed to the position of the secondary transfer nip has been conveyed from a sheet feeding unit 26 disposed on the lower side of the apparatus body 100 of the image forming apparatus 1000, via a sheet feeding roller 27, paired registration rollers 28, and the like. Specifically, a plurality of the recording media P such as transfer sheets are superimposed on one another and stored in the sheet feeding unit 26. In addition, if the sheet feeding roller 27 is driven to rotate in the counterclockwise direction in FIG. 1, the uppermost recording medium P is fed toward a portion between the rollers of the paired registration rollers 28.

The recording medium P conveyed to the paired registration rollers 28 (paired timing rollers) once stops at the position of a roller nip of the paired registration rollers 28 that have stopped the rotational driving. Then, the paired registration rollers 28 are driven to rotate at a timing appropriate for the color image on the intermediate transfer belt 8, and the recording medium P is conveyed toward the secondary transfer nip. In this manner, a desired color image is transferred onto the recording medium P.

After that, the recording medium P on which the color image has been transferred at the position of the secondary transfer nip is conveyed to the position of a fixing unit 20. Then, at the position, by the heat and the pressure of a fixing belt and a pressure roller, the color image transferred on the surface is fixed onto the recording medium P. After that, the recording medium P is ejected by paired sheet ejection rollers to the outside of the apparatus. The recording media P that have been ejected by the paired sheet ejection rollers to the outside of the apparatus are sequentially stacked on a stack portion as output images. In this manner, a series of image formation processes in the image forming apparatus 1000 is completed.

Next, referring to FIG. 2, the configuration and the operation of the developing unit 5Y (developing device) in the image forming unit 6Y will be described in more detail. The developing unit 5Y includes a developing roller 51Y opposing the photoconductor drum 1Y, a doctor blade 52Y opposing the developing roller 51Y, two conveying screws 55Y disposed in a developer container, a toner replenishment passage 43Y communicated with the developer container via an opening, a density detection sensor 56Y for detecting the density of toner in developer, and the like. The developing roller 51Y includes a magnet fixedly installed thereinside, a sleeve rotating around the magnet, and the like. Two-component developer G including carrier and toner is contained in the developer container.

The developing unit 5Y having the above-described configuration operates in the following manner. The sleeve of the developing roller 51Y is rotating in a direction indicated by arrow R1 in FIG. 2. In addition, developer G borne on the developing roller 51Y by a magnetic field formed by the magnet moves on the developing roller 51Y in accordance with the rotation of the sleeve. Here, the developer G in the developing unit 5Y is adjusted so that the rate of toner in the developer (toner density) falls within a predetermined range. After that, toner replenished into the developer container circulates in two isolated developer containers (corresponds to the movement in a direction vertical to a sheet face on which FIG. 2 is printed) while being mixed with the developer G and stirred by the two conveying screws 55Y. Then, the toner in the developer G is attracted to the carrier by frictional charging with the carrier, and is borne on the developing roller 51Y together with the carrier by magnetic force formed on the developing roller 51Y.

The developer G borne on the developing roller 51Y is conveyed in the direction indicated by arrow R1 in FIG. 2, to reach the position of the doctor blade 52Y. Then, after the developer amount of the developer G on the developing roller 51Y is adjusted to an appropriate amount at the position, the developer G is conveyed to a position (corresponds to a developing area) opposing the photoconductor drum 1Y. Then, by an electric field formed in the developing area, toner is attracted to the latent image formed on the photoconductor drum 1Y. After that, developer G remaining on the developing roller 51Y reaches the upper side of the developer container in accordance with the rotation of the sleeve, and is detached from the developing roller 51Y at the position.

Next, the intermediate transfer belt device 15 in the first embodiment will be described in detail using FIGS. 3 and 4. Referring to FIG. 3, the intermediate transfer belt device 15 includes the intermediate transfer belt 8 serving as an image bearer, the four primary transfer rollers 9Y, 9M, 9C, and 9K, the drive roller 12A, the secondary transfer opposite roller 80 (transfer opposite member) serving as a roller member, the tension rollers 12B to 12D, the cleaning opposite roller 13, the intermediate transfer cleaner 10, the secondary transfer roller 70 (transfer member), and the like.

The intermediate transfer belt 8 is disposed to oppose the four photoconductor drums 1Y, 1M, 1C, and 1K bearing the toner images of the respective colors. The intermediate transfer belt 8 is stretched around and supported by mainly six roller members (correspond to the drive roller 12A, the secondary transfer opposite roller 80, the tension rollers 12B to 12D, and the cleaning opposite roller 13).

In the first embodiment, the intermediate transfer belt 8 includes polyvinylidene fluoride (PVDF), ethylene-tetrafluoroethylene copolymer (ETFE), polyimide (PI), polycarbonate (PC), and the like, in a single layer or a plurality of layers, and is obtained by dispersing conductive material such as carbon black. The intermediate transfer belt 8 is adjusted so that a volume resistivity falls with a range of $10^6$ to $10^{13}$ Ωcm, and a surface resistivity of a belt rear surface side falls with a range of $10^7$ to $10^{13}$Ω/□. In addition, the intermediate transfer belt 8 is set so that the thickness falls within a range of 20 to 200 μm. In the first embodiment, the thickness of the intermediate transfer belt 8 is set to about 60 μm, and the volume resistivity of the intermediate transfer belt 8 is set to about $10^9$ Ωcm. In addition, the surface of the intermediate transfer belt 8 can be coated with a release layer as necessary. At this time, fluorine-containing resin such as ethylene-tetrafluoroethylene copolymer (ETFE), polytetrafluoroethylene (PTFE), polyvinylidene fluoride (PVDF), perfluoroalkoxy fluorine-containing resin (PFA), tetrafluoroethylene-hexafluoropropylene copolymer (FEP), and vinyl fluoride (PVF) can be used as material used for coating. Nevertheless, the material is not limited to these. In addition, examples of the manufacturing method of the intermediate transfer belt 8 include a cast molding method, a centrifugal molding method, and the like. The step of polishing the surface of the intermediate transfer belt 8 is performed as necessary. In addition, the above-described volume resistivity of the intermediate transfer belt 8 was measured by using "Hiresta UPMCPHT45" (manufactured by Mitsubishi Chemical Corporation) under the condition of applied voltage being 100V.

The primary transfer rollers 9Y, 9M, 9C, and 9K oppose the respective photoconductor drums 1Y, 1M, 1C, and 1K via the intermediate transfer belt 8. Specifically, the primary transfer roller 9Y for yellow opposes the photoconductor drum 1Y for yellow via the intermediate transfer belt 8, the primary transfer roller 9M for magenta opposes the photoconductor drum 1M for magenta via the intermediate transfer belt 8, the primary transfer roller 9C for cyan opposes the photoconductor drum 1C for cyan via the intermediate transfer belt 8, and the primary transfer roller 9K for black (for black color) opposes the photoconductor drum 1K for black (for black color) via the intermediate transfer belt 8. Each of the primary transfer rollers 9Y, 9M, 9C, and 9K is an elastic roller in which a conductive sponge layer having an outer diameter of about 16 mm is formed on a cored bar having a diameter of 10 mm, and is adjusted so that the volume resistance falls within a range of $10^6$ to $10^{12}$Ω (preferably, $10^7$ to $10^9$Ω).

The drive roller 12A is driven by the drive motor to rotate. As a result, the intermediate transfer belt 8 travels in a predetermined travel direction (clockwise direction in FIG. 3). The three tension rollers 12B to 12D contact the inner circumferential face or the outer circumferential face of the intermediate transfer belt 8. The intermediate transfer cleaner 10 (cleaning blade) is installed between the secondary transfer opposite roller 80 and the tension roller 12B to oppose the cleaning opposite roller 13 via the intermediate transfer belt 8.

Figure 4:
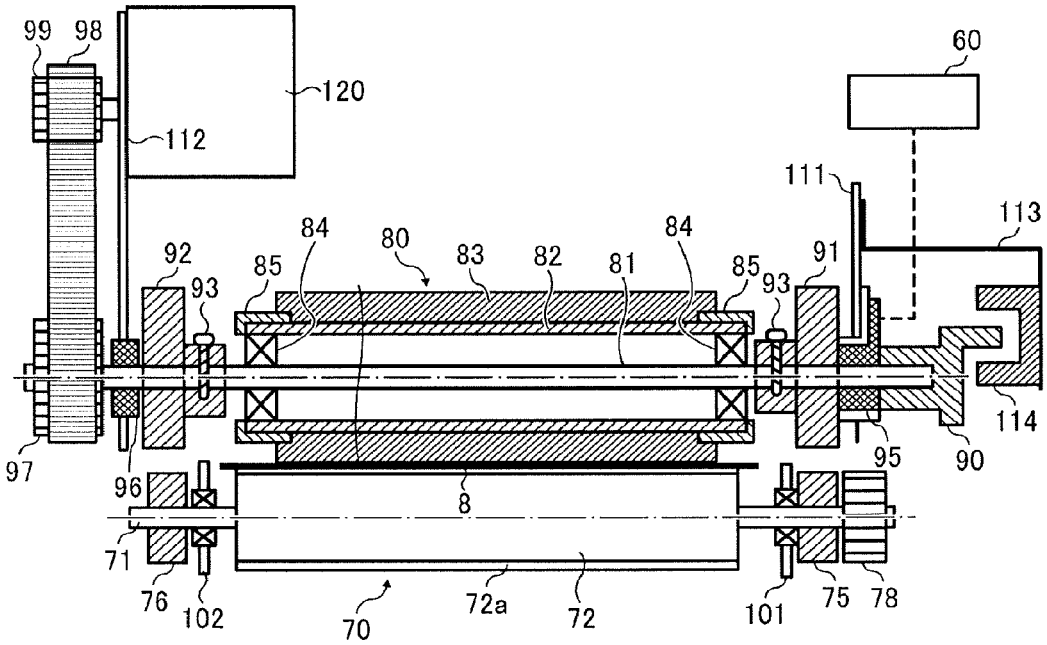
FIG. 4 is a cross-sectional view illustrating a state in which a secondary transfer opposite roller and a secondary transfer roller contact each other via the intermediate transfer belt according to an embodiment of the present disclosure, in an axial direction.

Referring to FIGS. 3 and 4, the secondary transfer opposite roller 80 (transfer opposite roller) serving as a roller member contacts the secondary transfer roller 70 via the intermediate transfer belt 8 (image bearer). The secondary transfer opposite roller 80 (transfer opposite roller) is a roller in which an elastic layer 83 (has a layer thickness of about 5 mm) made of nitrile rubber (NBR) foam rubber having a volume resistance of about $10^7$ to $10^9$ Ωcm, and a hardness (Asker-C hardness) of about 40 to 50 degrees is formed on the outer circumferential face of a cylindrical cored bar 82 made of stainless steel or the like. In addition, a resistance value (roller resistance value) of the secondary transfer opposite roller 80 is set to about 7.75±0.25 Log Ω. This resistance value (roller resistance value) corresponds to an average value of values obtained by measuring current values in the third rotation since the rotation start, at 32 points in the circumferential direction of a jig drum by pressing the secondary transfer opposite roller 80 against the jig drum with a load of 10 N on one side, and applying voltage of DC1±0.1 kV to the cored bar, in the hygrothermal environment of 25±5° C. and 60±10% RH. In addition, non-conductive members 85 (leakage stoppers) for preventing the leakage incidental to the application of high voltage are lightly pressed into both axial ends of the cored bar 82 of the secondary transfer opposite roller 80 in the first embodiment. This will be described in detail later.

In the first embodiment, the cored bar 82 of the secondary transfer opposite roller 80 is formed in a cylindrical shape, and the cored bar 82 is held on a shaft 81 (support shaft) via bearings 84 (are ball bearings having conductivity from an inner ring side to an outer inner ring). Specifically, the bearings 84 are pressed into the both end faces in the axial direction (width direction) of the cored bar 82, and the shaft 81 made of a conductive metal material is inserted into these bearings 84. Thus, in the secondary transfer opposite roller 80, the shaft 81 is formed to be rotatable independently of the cored bar 82 (and the elastic layer 83) rotating together with the intermediate transfer belt 8 by the friction resistance with the intermediate transfer belt 8. The both ends in the axial direction (corresponds to a direction vertical to a sheet face on which FIG. 3 is printed, and to a horizontal direction in FIG. 4) of the shaft 81 are rotatably held on side plates 111 and 112 of a housing of the intermediate transfer belt device 15 that holds the secondary transfer opposite roller 80, via bearings 95 and 96 (slide bearings). In addition, on one end in the axial direction of the shaft 81, a pulley 97 is installed to be rotatable together with the shaft 81. In addition, a timing belt 98 is stretched around the pulley 97 and a pulley 99 installed on a motor shaft of a stepping motor 120 fixedly installed on the side plate 112 on one end side in the axial direction. With such a configuration, the shaft 81 is rotated with an arbitrary rotation angle or the rotation is stopped, according to the driving or driving stop of the stepping motor 120, independently of the cored bar 82 (and the elastic layer 83).

In addition, cams 91 and 92 are secured and installed on both axial ends of the shaft 81 by fastening using screws 93. In addition, when the rotation angle of the shaft 81 is adjusted through the drive control of the stepping motor 120 so that the cams 91 and 92 do not contact below-described rollers 75 and 76 of the secondary transfer roller 70, the secondary transfer opposite roller 80 and the secondary transfer roller 70 enter a state in which the secondary transfer opposite roller 80 and the secondary transfer roller 70 contact each other via the intermediate transfer belt 8 (corresponds to the state in FIGS. 3 and 4), and a normal image formation process (secondary transfer step) is performed. In contrast to this, when the rotation angle of the shaft 81 is adjusted through the drive control of the stepping motor 120 so that the cams 91 and 92 contact the rollers 75 and 76 of the secondary transfer roller 70, the cams 91 and 92 push the secondary transfer roller 70 downward against the biasing force of a biasing member, and the secondary transfer roller 70 is separated from the secondary transfer opposite roller 80 (the intermediate transfer belt 8). Such a separating operation is performed when the secondary transfer step is not performed in the secondary transfer nip. This prevents such a failure that a pressed state continues for a long time, and permanent distortion is generated in the secondary transfer roller 70, the secondary transfer opposite roller 80, or the intermediate transfer belt 8. In addition, the control of the rotation angle of the shaft 81 is performed by controlling the stepping motor 120, and optically detecting a detection plate 90 fixedly installed on the other end side in the axial direction of the shaft 81, using a photosensor 114 (secured and installed on the side plate 111 via a bracket 113).

In addition, in the first embodiment, the secondary transfer opposite roller 80 (the cored bar 82) is electrically connected to a power source 60 serving as a bias output device, and a secondary transfer bias being high voltage of about −10 kV is applied from the power source 60. Specifically, referring to FIG. 4, the secondary transfer bias is applied from the bearing 95 (made of a conductive material) connected to the power source 60, to the cored bar 82 via the shaft 81 and the bearing 84 (made of a conductive material). The secondary transfer bias output from the power source 60 and applied to the secondary transfer opposite roller 80 is a bias for secondarily transferring the toner image borne on the intermediate transfer belt 8, onto the recording medium P conveyed to the secondary transfer nip, and is a bias (direct current voltage) having the same polarity (corresponds to the negative polarity in the first embodiment) as the polarity of toner. As a result, the toner borne on the toner bearing face (outer circumferential face) of the intermediate transfer belt 8 is electrostatically moved by a secondary transfer electric field from the secondary transfer opposite roller 80 side toward the secondary transfer roller 70 side.

The secondary transfer roller 70 (transfer roller) contacts the toner bearing face (outer circumferential face) of the intermediate transfer belt 8, to form the secondary transfer nip to which the recording medium P is conveyed. The secondary transfer roller 70 has an outer diameter of about 25 mm, and is a roller in which an elastic layer 72*a* having a hardness (JIS-A hardness) of about 60 to 70 degrees is formed (coated) on a hollow cored bar 72 made of stainless steel, aluminum, or the like, and having a diameter of about 24 mm. The elastic layer 72*a* of the secondary transfer roller 70 can be formed in a solid shape or a foam sponge shape by dispersing conductive feeler such as carbon, in rubber material such as polyurethane, ethylene-propylene diene rubber (EPDM), and silicone, or containing ionic conductive material. In the first embodiment, the volume resistivity of the elastic layer 72*a* is set to about $10^{7.5}$ Ωcm or less, for preventing the concentration of transfer current. In addition, a resistance value (roller resistance value) of the secondary transfer roller 70 is set to be $1\times10^{6}$Ω or less. The resistance value (roller resistance value) corresponds to an average value of values obtained by measuring current values in the third rotation since the rotation start, at 32 points in the circumferential direction of the jig drum by pressing the secondary transfer roller 70 against the jig drum with a load of 10 N on one side, and applying voltage of DC1±0.1 kV to the cored bar, in the hygrothermal environment of 22±1° C. and 55±5% RH. In addition, the releasability of the roller surface with respect to toner can be increased by forming a release layer such as semiconductive fluorine-containing resin and urethane resin, on the surface of the secondary transfer roller 70.

Flanges having shaft portions 71 are pressed into both axial ends of the cored bar 72 of the secondary transfer roller 70. In addition, the secondary transfer roller 70 (the shaft portions 71) is rotatably held on side plates 101 and 102 of a housing that holds the secondary transfer roller 70, via bearings. The housing that holds the secondary transfer roller 70 is formed to be movable in a vertical direction in FIGS. 3 and 4, together with the secondary transfer roller 70, and is biased by a biasing member in a direction to contact the intermediate transfer belt 8 (the secondary transfer opposite roller 80). In addition, the above-described rollers 75 and 76 that can contact the earns 91 and 92 are installed on the respective shaft portions 71 at both axial ends of the secondary transfer roller 70, to be relatively-rotatable with respect to the shaft portions 71. Furthermore, a gear 78 is installed on the shaft portion 71 on one end side in the axial direction of the secondary transfer roller 70, to be rotatable together with the shaft portion 71. If drive force is transmitted to the gear 78, the secondary transfer roller 70 is driven to rotate in a counterclockwise direction in FIG. 3. In addition, in the first embodiment, in the secondary transfer roller 70, the cored bar 72 is grounded via the shaft portions 71.

The secondary transfer opposite roller 80 serving as a roller member, which is characteristic in the first embodiment, will be described in detail below using FIGS. 4, 5, and the like. As described above using FIG. 4 and the like, the secondary transfer opposite roller 80 serving as a roller member in the first embodiment is a roller in which the elastic layer 83 is formed on the outer circumferential face of the cored bar 82, and the secondary transfer bias being high voltage of about −10 kV is applied to the cored bar 82.

Figure 5:
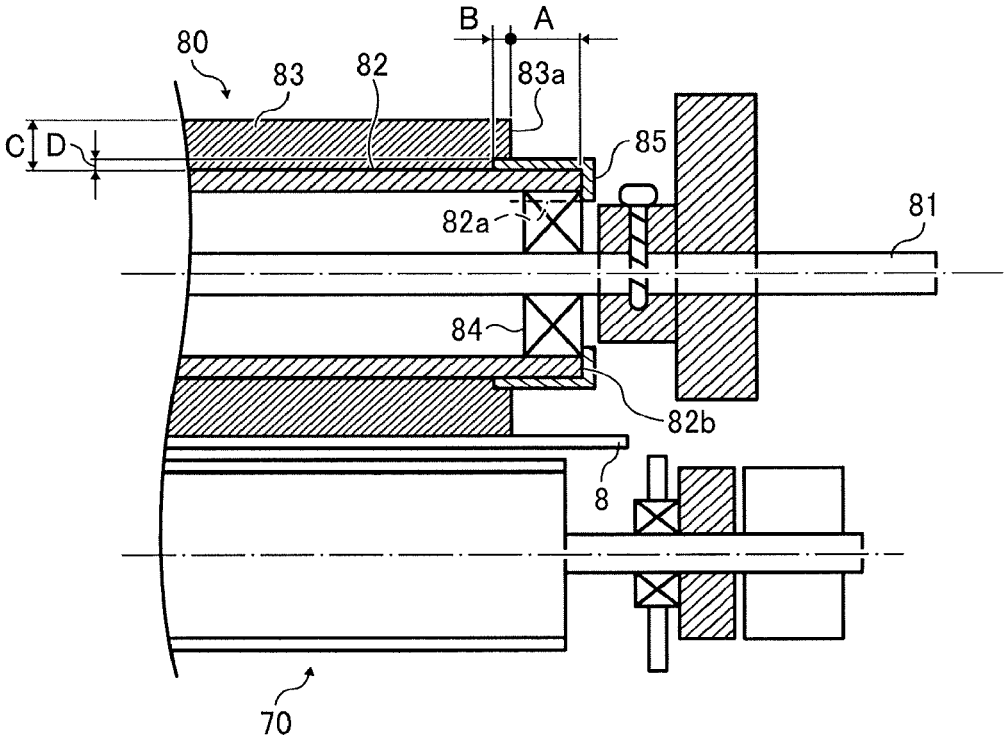
FIG. 5 is a cross-sectional view illustrating an axial end in FIG. 4 according to an embodiment of the present disclosure, in an enlarged manner.

Here, referring to FIG. 5 and the like, the cored bar 82 of the secondary transfer opposite roller 80 (roller member) has a projecting portion 82*a* formed to project from a range in which the elastic layer 83 is formed, toward an axial end. Specifically, the cored bar 82 of the secondary transfer opposite roller 80 (roller member) is provided with the projecting portion 82*a* on which the elastic layer 83 is not formed, and which is formed to project toward the axial end, on the outside of the range in the axial direction (corresponds to the horizontal direction in FIGS. 4 and 5) in which the elastic layer 83 is formed. In other words, the elastic layer 83 is stacked on the outer circumferential face of the cored bar 82 not throughout the entire regions in the axial direction, but the elastic layer 83 is stacked on a range obtained by excluding a fixed range A (having about 5 mm) at each axial end. The projecting portion 82*a* is formed on the cored bar 82 (the secondary transfer opposite roller 80) in this manner for the processing-related reason for forming the elastic layer 83 having a layer thickness uniform to some extent, on the cored bar 82. Specifically, in the step of stacking the elastic layer 83 on the cored bar 82, first, the elastic layer 83 is pressed onto the cored bar 82. In this state, the outer diameter cannot be uniform because of the deformation of the elastic layer 83. Thus, cutting is subsequently performed in a state in which both axial ends of the cored bar 82 are chucked, thereby uniformizing the outer diameter of the elastic layer 83. In this manner, the projecting portions 82*a* are provided at both axial ends of the cored bar 82 for the chucking in the cutting step.

In addition, as illustrated in FIG. 5, in the secondary transfer opposite roller 80 (roller member) in the first embodiment, the non-conductive member 85 made of a non-conductive material is installed on the projecting portion 82*a* to bite into an end face 83*a* at the axial end of the elastic layer 83. Specifically, in the secondary transfer opposite roller 80 (roller member) in the first embodiment, the non-conductive member 85 made of a non-conductive material such as polycarbonate (PC) that has a high voltage resistance is installed on the projecting portion 82*a* in a state in which the non-conductive member 85 bites into the end face 83*a* at the axial end of the elastic layer 83, so as not to expose the outer circumferential face of the projecting portion 82*a*. In FIG. 5, only one end side in the axial direction of the secondary transfer opposite roller 80 is illustrated. As illustrated in FIG. 4, the non-conductive member 85 is similarly installed on the other end side in the axial direction of the secondary transfer opposite roller 80.

By providing the non-conductive member 85 in this manner, the projecting portion 82*a* of the cored bar 82, which is made of a conductive metal material, and to which high voltage is to be applied, is covered by the non-conductive member 85 without any clearances, without directly opposing the intermediate transfer belt 8 or the cored bar 72 of the secondary transfer roller 70 at a short distance. This reliably reduces such a failure that leakage is generated by the application of high voltage to the secondary transfer opposite roller 80, and a transfer failure or the like occurs.

Figure 6A:
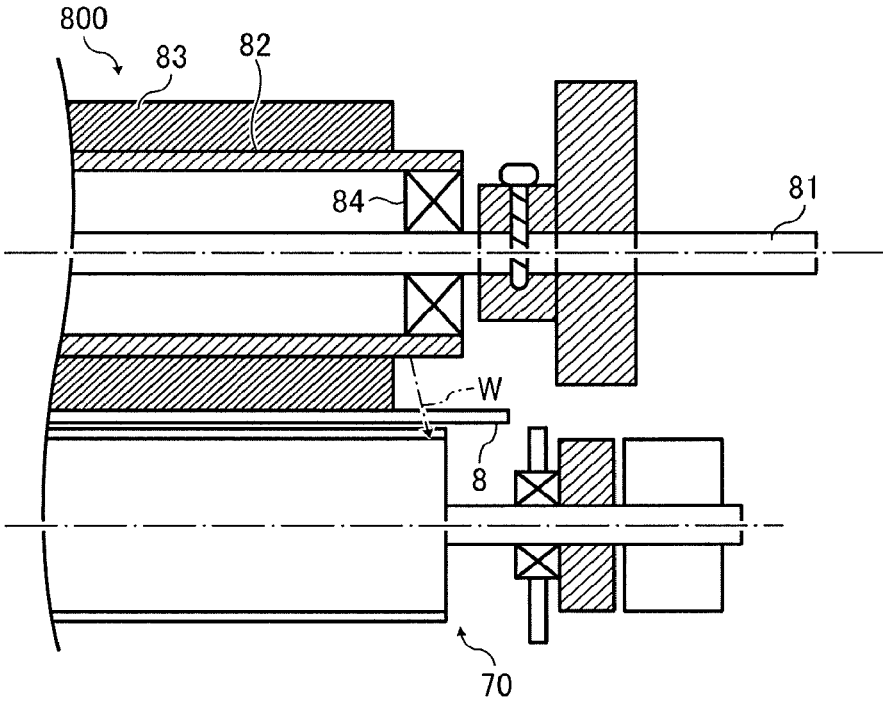
FIGS. 6A and 6B are enlarged cross-sectional views illustrating a state in which a secondary transfer opposite roller and a secondary transfer roller contact each other via an intermediate transfer belt in a conventional image forming apparatus.
Figure 6B:
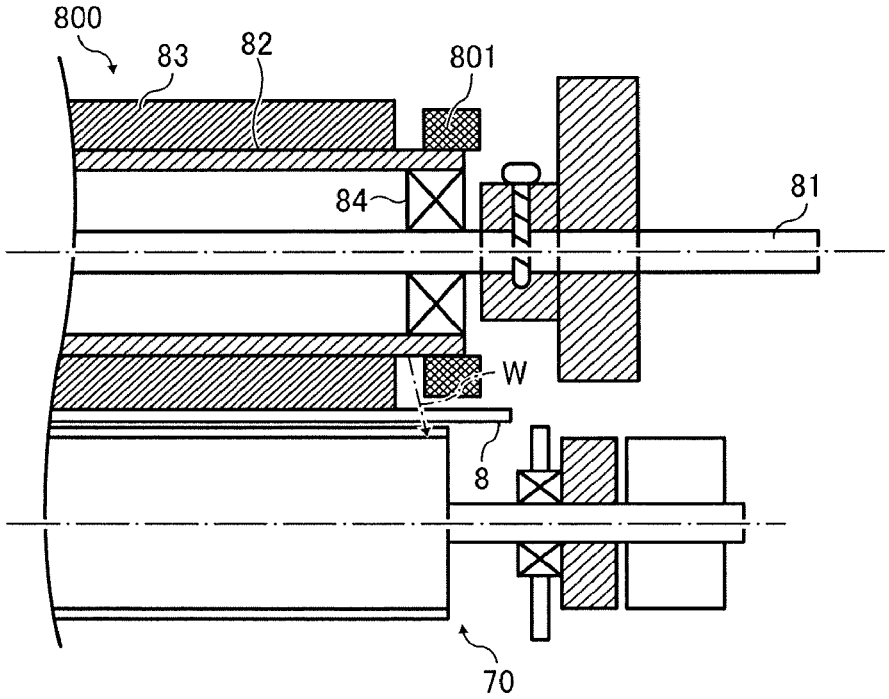

More specifically, as illustrated in FIG. 6A, if the non-conductive member 85 is not installed on a secondary transfer opposite roller 800, and a projecting portion of the cored bar 82 is in a bare state, by applying high voltage to the secondary transfer opposite roller 800, leakage W is easily generated by electricity discharged from the projecting portion toward the cored bar 72 while penetrating through the intermediate transfer belt 8 and the elastic layer 72*a* of the secondary transfer roller 70. In addition, as illustrated in FIG. 6B, even if a support 801 including a collar or a spacer made of a non-conductive material is installed on the secondary transfer opposite roller 800, a clearance is generated between the support 801 and the elastic layer 83, and a part of the projecting portion of the cored bar 82 becomes the bare state, so that the leakage W is easily generated as well. In contrast to this, in the first embodiment, the non-conductive member 85 having sufficient insulation properties is installed on the projecting portion 82*a* to completely block the route of the leakage W. Thus, the generation of the above-described leakage W can be prevented.

Here, in the first embodiment, it is preferable that the non-conductive member 85 is a cap secured to the cored bar 82 to cover an end face 82*b* of the projecting portion 82*a* in tight contact with the projecting portion 82*a*. In other words, the non-conductive member 85 is fixedly installed on the cored bar 82 to tightly contact the projecting portion 82*a*, with the end face 82*b* of the projecting portion 82*a* not being exposed. Specifically, the non-conductive member 85 is a cap in which a hole (formed so as not to prevent the movement of a ball of the bearing 84, and the relative rotational operation of the shaft 81) is formed on a bottom covering the end face 82*b* of the cored bar 82. In addition, the non-conductive member 85 is lightly pressed onto the cored bar 82 to cover the entire region of the outer circumferential face of the projecting portion 82*a* in a tight contact state by biting into a part of the end face 83*a* of the elastic layer 83, and to cover the entire region (is a region corresponding to the thickness of the cored bar 82) of the end face 82*b* of the projecting portion 82*a* in a tight contact state. Here, "the lightly-pressed state" refers to a state in which the non-conductive member 85 is pressed onto the projecting portion 82*a* with a condition set to such a degree that a deformation is not generated in the cored bar 82. It also refers to a state in which the non-conductive member 85 is not shifted in position or separated from the projecting portion 82*a* as long as the secondary transfer opposite roller 80 is used in a normal state without especially-large force being exerted on the non-conductive member 85. In other words, the non-conductive member 85 is installed to be rotatable together with the secondary transfer opposite roller 80, without shifting in position or idling. In this manner, by the non-conductive member 85 covering the end face 82*b* in addition to the outer circumferential face of the projecting portion 82*a*, the route of the leakage W from the end face 82*b* of the projecting portion 82*a* is blocked, so that the generation of the leakage W can be prevented further reliably.

As a procedure for mounting the above-described non-conductive members 85 to the secondary transfer opposite roller 80, after the cutting of the elastic layer 83 that is performed in a state in which the projecting portion 82*a* of the cored bar 82 is chucked has ended as described above, and after the bearings 84 have been completely pressed into the end face 82*b* of the cored bar 82, the non-conductive members 85 are lightly pressed onto the projecting portion 82*a*. In addition, after the non-conductive members 85 have been completely pressed onto the projecting portion 82*a*, the shaft 81 is inserted into the bearings 84. After that, the cams 91 and 92, and the like are fixedly installed, so that the assembly of the secondary transfer opposite roller 80 is completed.

Here, the non-conductive member 85 is preferably set so that a biting amount B with respect to the elastic layer 83 (corresponds to a length in the axial direction of a portion that bites into the elastic layer 83) becomes 0.5 mm or more. This is because, if the biting amount B is less than 0.5 mm, the adhesiveness of the elastic layer 83 and the non-conductive member 85 becomes insufficient, so that, a leakage route may be formed. In addition, in the first embodiment, the biting amount B of the non-conductive member 85 with respect to the elastic layer 83 is set to 0.5 mm. In addition, in the first embodiment, the non-conductive member 85 contacts the end face 82*b* at the axial end of the projecting portion 82*a*. Specifically, the position in the axial direction of the non-conductive member 85 is defined (the non-conductive member 85 is positioned) by being installed to contact the end face 82*b* at the axial end of the projecting portion 82*a*. With this configuration, the biting amount B of the non-conductive member 85 with respect to the elastic layer 83 is set with relatively-high accuracy, so that an effect of preventing the above-described leakage is exerted further reliably.

Here, the non-conductive member 85 is preferably formed so that a thickness D becomes 1.5 mm or more. This is because, if the thickness D is less than 1.5 mm, even though the non-conductive member 85 completely covers the surface of the projecting portion 82*a*, leakage may be generated to penetrate through the non-conductive member 85. In addition, in the first embodiment, the thickness D of the non-conductive member 85 is set to 1.5 mm.

In addition, the non-conductive member 85 is preferably formed so that a thickness (corresponds to the thickness D) in the radial direction of a portion that bites into the elastic layer 83 becomes two-thirds or less of a layer thickness C of the elastic layer 83. If the thickness D in the radial direction of the portion that bites into the elastic layer 83 becomes larger than two-thirds of the layer thickness C of the elastic layer 83, the end of the elastic layer 83 deforms to expand, by being bitten by the non-conductive member 85, so that a secondary transfer nip uniform in the axial direction fails to be formed, and a transfer failure occurs. In addition, in the first embodiment, the layer thickness C of the elastic layer 83 is set to 5 mm, and the thickness D of the non-conductive member 85 is set to 1.5 mm.

Figure 7:
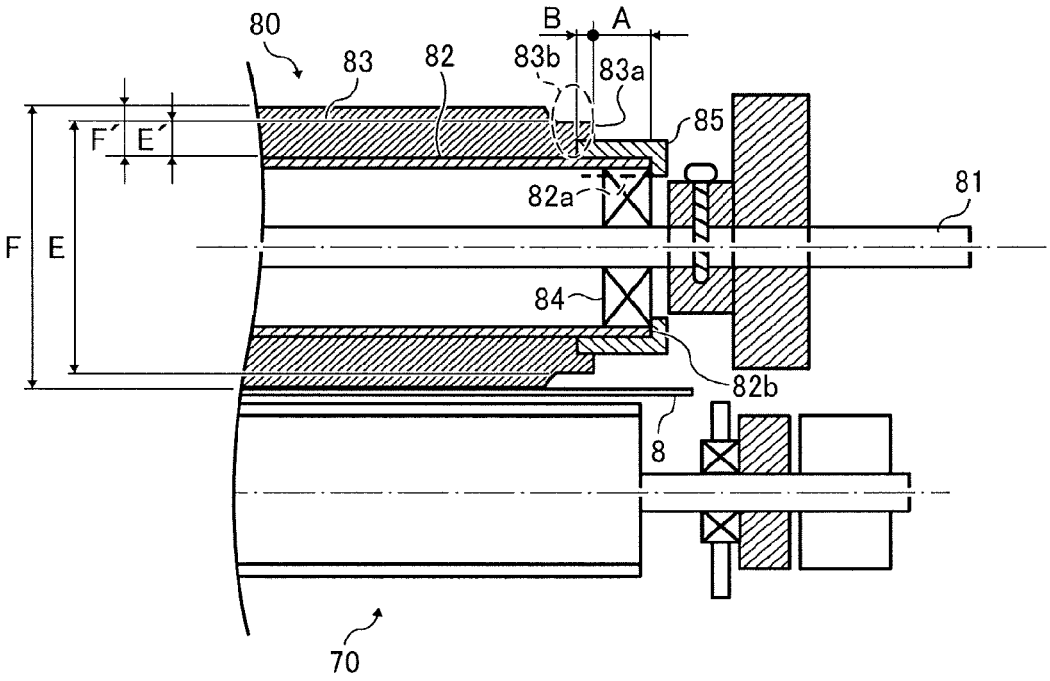
FIG. 7 is a cross-sectional view illustrating an axial end in a state in which a secondary transfer opposite roller and a secondary transfer roller contact each other via an intermediate transfer belt, serving as a variation, in an enlarged manner.

Here, FIG. 7 is an enlarged view illustrating an axial end of a secondary transfer opposite roller 80 (roller member) and a vicinity of the secondary transfer opposite roller 80, serving as a variation. In the secondary transfer opposite roller 80 (roller member) in the variation illustrated in FIG. 7, similarly to that in the first embodiment illustrated in FIG. 5, an elastic layer 83 is formed on the outer circumferential face of a cored bar 82, and a projecting portion 82*a* provided to project from the range in which the elastic layer 83 is formed, toward an axial end has a non-conductive member 85 provided to bite into an end face 83*a* of the elastic layer 83. In addition, the elastic layer 83 of the secondary transfer opposite roller 80 in the variation illustrated in FIG. 7 is formed so that an outer diameter E of a small diameter portion 83*b* of the axial end (corresponds to a portion surrounded by a broken line) becomes smaller than an outer diameter F of the other portions (E<F is satisfied), unlike that in the first embodiment illustrated in FIG. 5. In addition, the elastic layer 83 of the secondary transfer opposite roller 80 in the variation is formed so that a thickness E' of the small diameter portion 83*b* of the axial end becomes smaller than a thickness F' of the other portions (E'<F' is satisfied).

Specifically, in the step of stacking the elastic layer 83 on the cored bar 82, first, the elastic layer 83 is pressed onto the cored bar 82, cutting is subsequently performed in a state in which both axial ends of the cored bar 82 are chucked, to uniformize the outer diameter F of the elastic layer 83, and the cutting is further performed only on the axial end of the elastic layer 83 to make the outer diameter (see the dimension E of the small diameter portion 83*b* in FIG. 7) of the axial end sufficiently small. After that, after bearings 84 have been completely pressed into an end face 82*b* of the cored bar 82 in the state in which the diameter of the end of the elastic layer 83 is made small, the non-conductive members 85 are lightly pressed onto the projecting portion 82*a* to bite into the end face 83*a* of the elastic layer 83. At this time, even if force to expand in the radial direction is exerted on the elastic layer 83 by the non-conductive member 85 biting into the end face 83*a*, because the outer diameter of the portion is made sufficiently small, the outer diameter E of the small diameter portion 83*b* of the axial end eventually becomes smaller than the outer diameter F of the other portions (corresponds to the state in FIG. 7). Then, after the non-conductive members 85 have completely pressed onto the projecting portion 82*a*, the shaft 81 is inserted into the bearings 84. After that, the cams 91 and 92, and the like are fixedly installed, so that the assembly of the secondary transfer opposite roller 80 is completed.

Such a configuration can prevent the occurrence of such a failure that the end of the elastic layer 83 deforms to expand, and a secondary transfer nip uniform in the axial direction fails to be formed, and a transfer failure occurs. Specifically, by the non-conductive member 85 biting into the end face 83*a* of the elastic layer 83, if the end of the elastic layer 83 expands as compared with the other portions, the secondary transfer nip becomes ununiform in the axial direction, so that a transfer failure such as transfer unevenness is easily generated in a toner image transferred from the intermediate transfer belt 8 onto the recording medium P. In particular, as illustrated in FIG. 4, if the range in the axial direction of the elastic layer 83 in the secondary transfer opposite roller 80 is formed to be included in the range in the axial direction of the elastic layer 72*a* in the secondary transfer roller 70, if the outer diameter of the elastic layer 83 in the secondary transfer opposite roller 80 locally increases, the secondary transfer nip becomes ununiform in the axial direction, so that a transfer failure such as transfer unevenness is easily generated in a toner image transferred from the intermediate transfer belt 8 onto the recording medium P. In contrast to this, in the variation illustrated in FIG. 7, the elastic layer 83 is formed so that the outer diameter of the end of the elastic layer 83 does not become larger than the outer diameter of the other portions, even if the non-conductive member 85 bites into the end face 83*a* of the elastic layer 83. This prevents the generation of leakage starting from the projecting portion 82*a*, while reliably preventing such a failure that the secondary transfer nip becomes ununiform in the axial direction.

As described above, in the first embodiment, in the secondary transfer opposite roller 80 (roller member), the cored bar 82 with the elastic layer 83 formed on its outer circumferential face has the projecting portion 82*a* formed to project from the range in which the elastic layer 83 is formed, toward the axial end. In addition, the non-conductive member 85 is installed on the projecting portion 82*a* to bite into the end face 83*a* at the axial end of the elastic layer 83. This can make it difficult to generate leakage even if high voltage is applied to the secondary transfer opposite roller 80.

Second Embodiment

Figure 8:
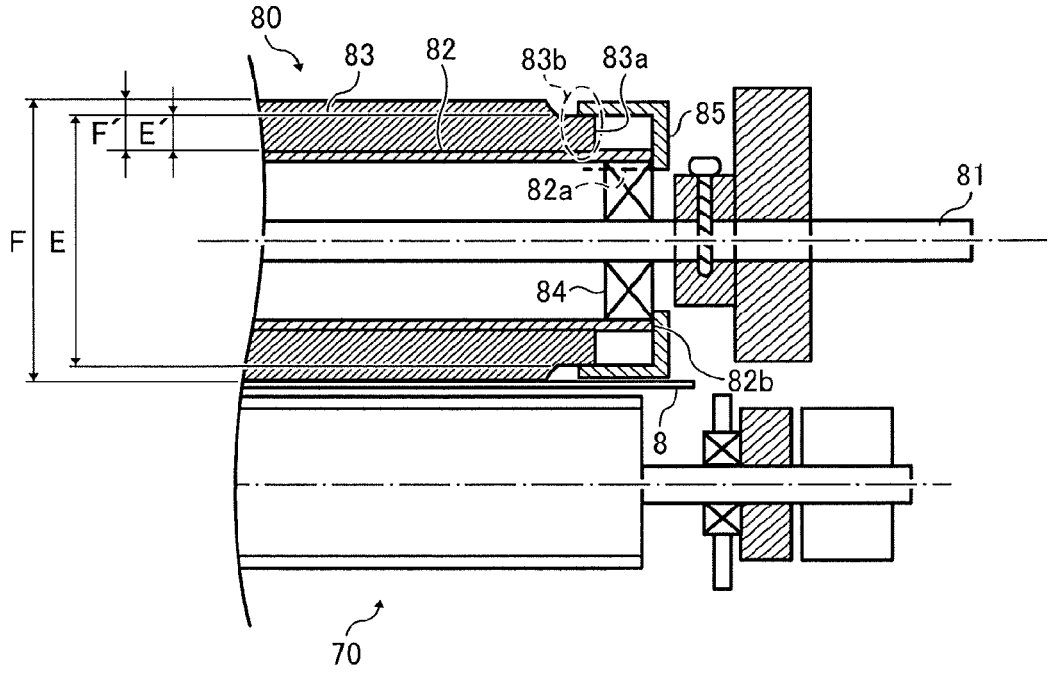
FIG. 8 is a cross-sectional view illustrating an axial end in a state in which a secondary transfer opposite roller and a secondary transfer roller contact each other via an intermediate transfer belt, in an image forming apparatus according to a second embodiment of the present disclosure, in an enlarged manner.

A second embodiment of the present disclosure will be described in detail referring to FIG. 8. FIG. 8 is an enlarged view illustrating an axial end of a secondary transfer opposite roller 80 (roller member) in the second embodiment and a vicinity of the secondary transfer opposite roller 80, and corresponds to FIG. 5 in the above-described first embodiment. The secondary transfer opposite roller 80 in the second embodiment differs in that a non-conductive member 85 is fitted to a small diameter portion 83*b* of an elastic layer 83, from that in the above-described first embodiment, in which the non-conductive member 85 is installed to bite into the end face 83*a* of the elastic layer 83.

As illustrated in FIG. 8, in the secondary transfer opposite roller 80 (roller member) in the second embodiment, similarly to that in the above-described first embodiment illustrated in FIG. 5, the elastic layer 83 is formed on the outer circumferential face of a cored bar 82, and a projecting portion 82*a* is provided to project from the range in which the elastic layer 83 is formed, toward the axial end. In addition, in the elastic layer 83 of the secondary transfer opposite roller 80 in the second embodiment, similarly to that in the variation illustrated in FIG. 7, the axial end is provided with the small diameter portion 83*b* formed so that an outer diameter becomes smaller than that of the other portions. Specifically, in the step of stacking the elastic layer 83 on the cored bar 82, first, the elastic layer 83 is pressed onto the cored bar 82, cutting is subsequently performed in a state in which both axial ends of the cored bar 82 are chucked, to uniformize an outer diameter F of the elastic layer 83, and the cutting is further performed only on the axial end of the elastic layer 83 to make an outer diameter E of the axial end small, thereby forming the small diameter portion 83*b*.

In addition, in the secondary transfer opposite roller 80 in the second embodiment, the non-conductive member 85 is installed to cover the projecting portion 82*a* by being fitted to the small diameter portion 83*b* of the elastic layer 83. Specifically, the non-conductive member 85 is installed at an end of the secondary transfer opposite roller 80 with being tightly fitted to the small diameter portion 83*b* without any clearances, to such a degree that the small diameter portion 83*b* elastically deforms small and slightly in the radial direction, so as not to expose the outer circumferential face (and an end face 82*b*) of the projecting portion 82*a*. An inner diameter of the non-conductive member 85 is formed to correspond to an outer diameter smaller than the outer diameter F of the portions of the elastic layer 83 that are other than the small diameter portion 83*b*. In addition, the outer diameter E of the small diameter portion 83*b* is set to be larger than the inner diameter of the non-conductive member 85 by a predetermined amount. In addition, the small diameter portion 83*b* of the secondary transfer opposite roller 80 in the second embodiment is formed so that a thickness E' of the small diameter portion 83*b* becomes smaller than a thickness F' of the portions of the elastic layer 83 that are other than the small diameter portion 83*b* (E'<F is satisfied).

In addition, after the small diameter portion 83*b* is formed at the end of the elastic layer 83 by performing the cutting as described above, the non-conductive member 85 is lightly pressed into the small diameter portion 83*b* to cover the projecting portion 82*a* by being fitted to the small diameter portion 83*b*. Then, after the non-conductive member 85 has been completely pressed into the small diameter portion 83*b*, a shaft 81 is inserted into a bearing 84. After that, cams 91 and 92, and the like are fixedly installed, so that the assembly of the secondary transfer opposite roller 80 is competed.

Even with such a configuration, the projecting portion 82*a* of the cored bar 82, which is made of a conductive metal material, and to which high voltage is to be applied, is covered by the non-conductive member 85 without any clearances, without directly opposing an intermediate transfer belt 8 or a cored bar 72 of a secondary transfer roller 70 at a short distance. This reliably reduces such a failure that leakage is generated by the application of high voltage to the secondary transfer opposite roller 80, and a transfer failure or the like occurs.

In addition, in the second embodiment, even if the non-conductive member 85 is fitted to the end of the elastic layer 83, the fitted part of the non-conductive member 85 is formed to be the small diameter portion 83*b*. This can prevent the occurrence of such a failure that the end of the elastic layer 83 deforms to expand, and a secondary transfer nip uniform in the axial direction fails to be formed, and a transfer failure occurs. Specifically, if the end of the elastic layer 83 expands as compared with the other portions, the secondary transfer nip becomes ununiform in the axial direction, so that a transfer failure such as transfer unevenness is easily generated in a toner image transferred from the intermediate transfer belt 8 onto a recording medium P. In particular, as illustrated in FIG. 4, if the range in the axial direction of the elastic layer 83 in the secondary transfer opposite roller 80 is formed to be included in the range in the axial direction of an elastic layer 72*a* in the secondary transfer roller 70, if the outer diameter of the elastic layer 83 in the secondary transfer opposite roller 80 locally increases, the secondary transfer nip becomes ununiform in the axial direction, so that a transfer failure such as transfer unevenness is easily generated in a toner image transferred from the intermediate transfer belt 8 onto the recording medium P. In contrast to this, in the second embodiment, even if the non-conductive member 85 is fitted to the elastic layer 83, the outer diameter of the end of the elastic layer 83 is formed so as not to become larger than the outer diameter of the other portions in a state in which the non-conductive member 85 is fitted. This prevents the generation of leakage starting from the projecting portion 82*a*, while reliably preventing such a failure that the secondary transfer nip becomes ununiform in the axial direction.

In addition, in the second embodiment, as illustrated in FIG. 8, the non-conductive member 85 is fitted to the small diameter portion 83*b* without contacting the outer circumferential face of the projecting portion 82*a*. In contrast to this, the non-conductive member 85 can be fitted to the small diameter portion 83*b* in a state in which the non-conductive member 85 contacts (is fitted to) a part or all of the outer circumferential face of the projecting portion 82*a*. In this case, as compared with a case in which the non-conductive member 85 is fitted only to the small diameter portion 83*b* having elasticity, the non-conductive member 85 can be stably fitted to the secondary transfer opposite roller 80.

As described above, in the second embodiment, in the secondary transfer opposite roller 80 (roller member), the cored bar 82 with the elastic layer 83 formed on its outer circumferential face has the projecting portion 82*a* formed to project from the range in which the elastic layer 83 is formed, toward the axial end. In addition, the small diameter portion 83*b* is formed at the axial end of the elastic layer 83, and the non-conductive member 85 is installed to cover the projecting portion 82*a* by being fitted to the small diameter portion 83*b* of the elastic layer 83. This makes it difficult to generate leakage even if high voltage is applied to the secondary transfer opposite roller 80.

In addition, in each of the above-described embodiments, the secondary transfer step is performed by applying the secondary transfer bias (is voltage having the negative polarity) only to the secondary transfer opposite roller 80 of the secondary transfer roller 70 and the secondary transfer opposite roller 80 that contact each other via the intermediate transfer belt 8 to form the secondary transfer nip to which the recording medium P is conveyed. In contrast to this, the secondary transfer step can be performed by directly or indirectly applying the secondary transfer bias (is voltage having a positive polarity) only to the secondary transfer roller 70 serving as a roller member. Alternatively, the secondary transfer step can be performed by directly or indirectly applying the secondary transfer bias to both of the secondary transfer roller 70 and the secondary transfer opposite roller 80. Even in such a case, by applying the present disclosure to a roller member to which the secondary transfer bias is to be applied, an effect similar to that in each of the above-described embodiments can be obtained. In addition, in each of the above-described embodiments, by applying the present disclosure also to a roller member to which the secondary transfer bias is not to be applied (is the secondary transfer roller 70 in each of the above-described embodiments), a leakage route from the secondary transfer opposite roller 80 to which the secondary transfer bias is to be applied can be blocked on the side of the opposing secondary transfer roller 70. This can reduce the generation of leakage.

In addition, in each of the above-described embodiments, the present disclosure is applied to the secondary transfer opposite roller 80 in which the cored bar 82 is formed into a cylindrical shape (hollow shape). Nevertheless, the present disclosure can also be applied to a secondary transfer opposite roller in which a cored bar is formed into a columnar shape (solid shape). In addition, even in such a case, an effect similar to that in each of the above-described embodiments can be obtained.

In addition, in each of the above-described embodiments, as illustrated in FIG. 5 and the like, the non-conductive member 85 is installed to contact the end face 82*b* at the axial end of the projecting portion 82*a* throughout the whole circumference (to cover the entire end face 82*b*). Nevertheless, the shape of the non-conductive member 85 is not limited to this. For example, the non-conductive member 85 may be formed to contact only a part of the whole circumference of the end face 82*b* at the axial end of the projecting portion 82*a*. In other words, only a part of the end face 82*b* of the projecting portion 82*a* may be covered, and the remaining portion may be exposed. In addition, in each of the above-described embodiments, the non-conductive member 85 is positioned by contacting the cored bar 82. Alternatively, the non-conductive member 85 may be positioned with respect to a member other than the cored bar 82. For example, the non-conductive member 85 may be positioned with respect to the bearing 84, the earn 91, or the like. In addition, the non-conductive member 85 may be installed to cover the end face 82*b* at the axial end of the projecting portion 82*a*, and an end face at an axial end of the bearing 84. In addition, even in such cases, an effect similar to that in each of the above-described embodiments can be obtained.

In addition, in each of the above-described embodiments, in the color image forming apparatus 1000, the present disclosure is applied to the secondary transfer opposite roller 80 that forms a secondary transfer nip by contacting the secondary transfer roller 70 via the intermediate transfer belt 8 serving as an image bearer. In contrast to this, in a monochromatic image forming apparatus, the present disclosure can be applied also to a transfer roller serving as a roller member that forms a transfer nip by contacting a photoconductor drum serving as an image bearer. In addition, the application target of the present disclosure is not limited to the secondary transfer opposite roller 80. The present disclosure can be applied to all roller members as long as the roller members are roller members in which elastic layers are formed on cored bars, projecting portions are formed, and leakage can be generated. In addition, even in such a case, an effect similar to that in each of the above-described embodiments can be obtained.

In addition, in each of the above-described embodiments, the present disclosure is applied to the image forming apparatus 1000 formed so that the secondary transfer roller 70 directly contacts the intermediate transfer belt 8 to form a secondary transfer nip. In contrast to this, the present disclosure can be naturally applied to an image forming apparatus formed so that a secondary transfer roller contacts an intermediate transfer belt via a secondary transfer conveyance belt (is an endless belt being stretched around a plurality of roller members, and traveling in a conveyance direction of the recording medium) to form a secondary transfer nip. In addition, even in such a case, an effect similar to that in each of the above-described embodiments can be obtained.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. In addition, the number, the position, the shape, and the like of the components are not limited to those in each of the above-described embodiments. The number, the position, the shape, and the like that are preferable for practicing the present disclosure can be employed.

What is claimed is:

1. An image forming apparatus comprising:

an image bearer to bear a toner image;

a transfer roller to form a transfer nip between the transfer roller and the image bearer;

a roller member disposed opposing the transfer roller via the image bearer at the transfer nip and comprising:

a cored bar;

an elastic layer disposed on an outer circumferential face of the cored bar, the cored bar having a projecting portion projecting beyond a range in which the elastic layer is disposed, toward an axial end of the cored bar; and a non-conductive member made of a non-conductive material, the non-conductive member disposed on the projecting portion, the non-conductive member biting an end face of an axial end of the elastic layer and covering an axial end face of the projecting portion; and a power source to output a transfer bias to transfer the toner image from the image bearer onto a recording medium at the transfer nip, the power source to directly or indirectly apply the transfer bias to the cored bar.

2. The image forming apparatus according to claim 1, wherein a portion of the non-conductive member biting into the elastic layer has a radial thickness of two-thirds or less of a layer thickness of the elastic layer.

3. The image forming apparatus according to claim 1, wherein an outer diameter of the axial end of the elastic layer is smaller than an outer diameter of another portion of the elastic layer.

4. The image forming apparatus according to claim 1, wherein the non-conductive member is disposed in contact with the axial end face of an axial end of the projecting portion.

5. The image forming apparatus according to claim 4, wherein the non-conductive member is a cap covering the axial end face of the projecting portion, and wherein the cap is secured to the cored bar in contact with the projecting portion.

6. The image forming apparatus according to claim 1, further comprising:

a bearing; and a shaft supporting the cored bar via the bearing, wherein the cored bar is cylindrical.

7. The image forming apparatus according to claim 1, further comprising a photoconductor having a surface on which the toner image is to be formed, wherein the image bearer is an intermediate transfer belt onto which the toner image is to be transferred from the photoconductor.

8. The image forming apparatus according to claim 1, wherein the elastic layer is an outer circumferential face of the roller member.

9. A roller member comprising:

a cored bar;

an elastic layer disposed on an outer circumferential face of the cored bar, the cored bar having a projecting portion projecting beyond a range in which the elastic layer is disposed, toward an axial end of the cored bar; and a non-conductive member made of a non-conductive material, the non-conductive member disposed on the projecting portion, the non-conductive member biting an end face of an axial end of the elastic layer, wherein the non-conductive member has a thickness of 1.5 mm or more.

10. An image forming apparatus comprising:

an image bearer to bear a toner image;

a roller member disposed opposing the image bearer to form a transfer nip between the roller member and the image bearer, the roller member comprising:

a cored bar;

an elastic layer disposed on an outer circumferential face of the cored bar, the cored bar having a projecting portion projecting beyond a range in which the elastic layer is disposed, toward an axial end of the cored bar; and a non-conductive member made of a non-conductive material, the non-conductive member disposed on the projecting portion, the non-conductive member biting an end face of an axial end of the elastic layer and covering an axial end face of the projecting portion; and a power source to output a transfer bias to transfer the toner image from the image bearer onto a recording medium at the transfer nip, the power source to directly or indirectly apply the transfer bias to the cored bar.

11. The image forming apparatus according to claim 10, further comprising a photoconductor having a surface on which the toner image is to be formed, wherein the image bearer is an intermediate transfer belt onto which the toner image is to be transferred from the photoconductor.

12. The image forming apparatus according to claim 10, wherein a portion of the non-conductive member biting into the elastic layer has a radial thickness of two-thirds or less of a layer thickness of the elastic layer.

13. The image forming apparatus according to claim 10, wherein an outer diameter of the axial end of the elastic layer is smaller than an outer diameter of another portion of the elastic layer.

14. The image forming apparatus according to claim 10, wherein the non-conductive member is disposed in contact with the axial end face of an axial end of the projecting portion.

15. The image forming apparatus according to claim 14, wherein the non-conductive member is a cap covering the axial end face of the projecting portion, and wherein the cap is secured to the cored bar in contact with the projecting portion.

16. The image forming apparatus according to claim 10, further comprising:

a bearing; and a shaft supporting the cored bar via the bearing, wherein the cored bar is cylindrical.

17. The image forming apparatus according to claim 10, wherein the elastic layer is an outer circumferential face of the roller member.

* * * * *